US007240703B2

(12) United States Patent
Hu

(10) Patent No.: US 7,240,703 B2
(45) Date of Patent: Jul. 10, 2007

(54) AUTOMATIC PENCIL SHARPENER

(75) Inventor: Jingyi Hu, Shenzhen (CN)

(73) Assignee: Ringsun (Shenzhen) Industrial Limited, Shenzhen (CN)

( * ) Notice: Subject to any disclaimer, the term of this patent is extended or adjusted under 35 U.S.C. 154(b) by 0 days.

(21) Appl. No.: 11/258,291

(22) Filed: Oct. 24, 2005

(65) Prior Publication Data

US 2006/0272743 A1 Dec. 7, 2006

(30) Foreign Application Priority Data

Jun. 2, 2005 (CN) ..... 2005 2 0034391 U

(51) Int. Cl.
*B43L 23/08* (2006.01)

(52) U.S. Cl. ..... 144/28.5; 144/28.72

(58) Field of Classification Search ..... 144/28.5, 144/28.6, 28.72, 28.8, 28.9, 28.11, 28.2; 30/451–462
See application file for complete search history.

(56) References Cited

U.S. PATENT DOCUMENTS 2,335,148 A 11/1943 Hoffman
2,545,779 A 3/1951 Harrison
2,822,781 A 2/1958 Burton
2,900,958 A 8/1959 Johnson
3,134,365 A 5/1964 Hori
3,712,351 A * 1/1973 Kuramochi ..... 144/28.72
3,860,049 A * 1/1975 Kuramochi ..... 144/28.72
4,601,316 A 7/1986 Verdi
4,966,208 A * 10/1990 Uang ..... 144/28.72
5,394,613 A 3/1995 Ku
6,065,514 A 5/2000 New

* cited by examiner

*Primary Examiner*—Shelley Self
(74) *Attorney, Agent, or Firm*—Knobbe, Martens, Olson & Bear LLP

(57) ABSTRACT

An automatic pencil sharpener having a motor, a transmission device, a cutter assembly, a feeding device, a feeding reverse mechanism, and a manual reverse mechanism. The feeding device has a pair of feeding rollers for feeding the pencil. The manual reverse mechanism for manually retreating the pencil has a pushing rod and a key switch. The pencil is fed by the feeding device and delivered to the cutter assembly. The cutter assembly processes the pencil. After the pencil is shaved, the feeding reverse mechanism drives the motor to rotate in a reverse direction so as to retreat the pencil from the sharpener. When the pencil is too short to shave and stops in the sharpener, the pencil is retreated from the sharpener by the manual reverse mechanism.

19 Claims, 6 Drawing Sheets

AUTOMATIC PENCIL SHARPENER

BACKGROUND OF THE INVENTION

1. Field of the Invention

The present invention is generally related to a pencil sharpener, and more particularly to an automatic pencil sharpener.

2. Description of the Related Art

A typical electric pencil sharpener comprises an electric motor, a gear train, a cutter assembly, and a receptacle for receiving a pencil or a pencil alignment device. The sharpener further comprises a switch for activating the motor, e.g. upon insertion of a pencil. When the pencil is positioned in the receptacle, the motor transfers its power to the cutter assembly through the gear train. The pencil is sharpened by a blade of the cutter assembly. Numerous innovations for pencil sharpeners have been provided in the prior art that will be described. Even though these innovations may be suitable for the specific individual purposes to which they are addressed, however, they differ from the present invention.

Pencil sharpeners exemplifying one or more of these characteristics are shown in U.S. Pat. No. 2,335,148 to Hoffman, U.S. Pat. No. 2,545,779 to Harrison, U.S. Pat. No. 2,822,781 to Burton, U.S. Pat. No. 2,900,958 to Johnson, U.S. Pat. No. 3,134,365 to Hori, and U.S. Pat. No. 4,601,316 to Verdi.

An early typical pencil sharpener, disclosed in U.S. Pat. No. 5,394,613 to Ku teaches a spring-driven pencil sharpener comprising a top cap having a top opening to receive a pencil and two corresponding slots to receive a fastening device that include a couple of hollow frames. The pencil sharpener comprises a housing which is constructed with a pair of coupling castings, each of which is accompanied by a lateral cover for disposing a pencil blade set and a spring-driven automatic device. The outline of the housing is preferably designed to cooperate with that of the cap to form an egg-like shape that is comfortable to the hand and looks nice. However, the pencil to be sharpened in the typical sharpener is manually fed into the housing, which is inconvenient comparing to an automatic one. In addition, the holding force for the pencil is provided by the user and is unstable, so the pencil sharpener is easily jammed.

Another conventional pencil sharpener, disclosed in U.S. Pat. No. 6,065,514, comprises a sharpening sub-assembly for sharpening pencils and first and second external shells having internal ribs defining surfaces for supporting the sharpening sub-assembly. The sharpening sub-assembly comprises an electric motor, a gear assembly, and a cutter assembly including a cutter gear module having an annular ring gear acting as a carrier support. The sub-assembly houses a pencil insertion switch and a receptacle presence switch. However, the holding force for the pencil is still provided by the user and is still unstable. The pencil sharpener is easily jammed.

It is apparent that numerous innovations for pencil sharpeners have been provided in the prior art. Furthermore, even though these innovations may be suitable for the specific individual purposes to which they are addressed, the pencil is still manually fed with a holding force that is difficult to control such that jamming frequently occurs.

SUMMARY OF THE INVENTION

In light of the foregoing, there is a need to improve the mechanism of the conventional pencil sharpener. The preferred embodiments provide a pencil sharpener which automatically feeds the pencil into and out of the pencil sharpener.

Accordingly, the preferred embodiments provide an automatic pencil sharpener capable of self-feeding into and self-retreating from the pencil sharpener.

Another embodiment provides an automatic pencil sharpener in which a pencil is manually retreated from the pencil sharpener when the pencil is short and can be stopped in the sharpener without being shaved.

An automatic pencil sharpener of the preferred embodiments comprises a motor, a transmission device, a cutter assembly, a feeding device, a feeding reverse mechanism, and a manual reverse mechanism. The transmission device is a gear train, comprising a motor pinion, a first, second and third transmission gears, successively meshing with one another in turn. The cutter assembly adapted for shaving a pencil comprises a blade support engaged with the transmission device, a blade fixed on the blade support, a pinion aligned coaxial with the blade and an inner ring gear meshing with the pinion. An active component, for example a crown gear, is mounted on a distal end of the blade support. The feeding device driven by the motor comprises a first feeding roller and a second feeding roller which sandwich the pencil and feed the pencil by friction. The feeding power is transmitted from the active component successively to the first feeding roller and the second feeding roller. The rotating direction of the first feeding roller is reverse to that of the second feeding roller.

The feeding device further comprises a first passive assembly and a second passive assembly. The active component is engaged with the first passive assembly, and the first passive assembly is engaged with the first feeding roller and the second passive assembly. The second passive assembly is engaged with the second feeding roller. The first passive assembly comprises a first gear, a second gear, a third gear, and a first rolling shaft supporting the first feeding roller, the second and the third gear. The first gear meshes with the active component, the second gear meshes with the first gear. The second passive assembly comprises a fourth gear and a second rolling shaft supporting the second feeding roller and the fourth gear. The fourth gear meshes with the third gear supported on the first rolling shaft.

The feeding reverse mechanism configured to retreat the pencil comprises a slide block, a triggering post and a reversal switch triggered by the post. The slide block pushes the post and the post triggers the reversal switch to drive the motor in a reverse direction. The pencil is fed by the feeding device and delivered to the cutter assembly. The cutter assembly shaves the pencil, after the pencil is processed, and the feeding reverse mechanism drives the motor to rotate in a reverse direction so as to retreat the pencil from the sharpener. The automatic pencil sharpener further comprises a manual reverse mechanism. The manual reverse mechanism comprises a pushing rod and a key switch. The pushing rod sticks out from the sharpener and is engaged with the key switch. The key switch is connected with the motor. Pressing the pushing rod triggers the key switch to drive the motor to rotate in a reverse direction.

DETAILED DESCRIPTION OF THE PREFERRED EMBODIMENT

Figure 1:
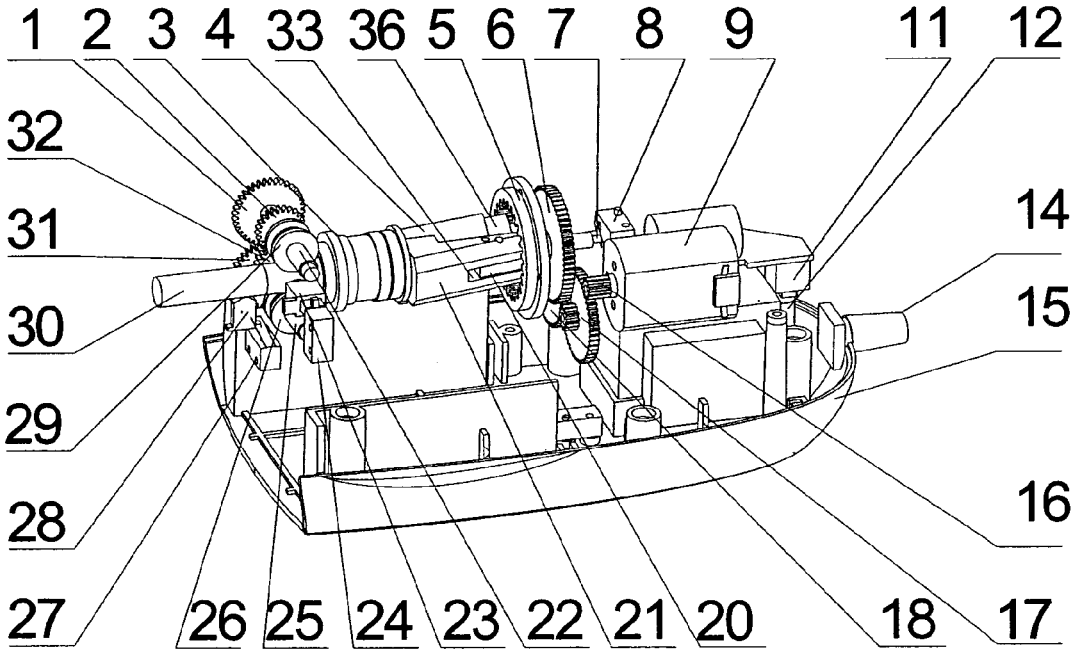
FIG. 1 is a perspective view of an automatic pencil sharpener in accordance with a preferred embodiment.

Referring to FIG. 1, the preferred embodiment relates to a pencil sharpener, more particularly, to an automatic pencil sharpener. The automatic pencil sharpener in accordance with the preferred embodiment comprises an enclosure 15. A motor 9, a cutter assembly, a transmission gear train, a feeding device, a feeding reverse device, and a manual reverse mechanism are received in the enclosure 15. The motor 9 provides the cutter assembly and the feeding device with power. The transmission gear train connecting the motor 9 with the cutter assembly transfers power from the motor 9 to the cutter assembly and the feeding device. The cutter assembly is configured for shaving a pencil. The feeding device is configured for feeding the pencil to a processing position. The feeding reverse device is configured for reversing the motor rotation to retreat the pencil from the sharpener. The manual reverse mechanism is configured for reversing the motor rotation to retreat the pencil from the sharpener manually, when the pencil is too short and stops in the sharpener. The motor 9 drives the transmission gear train. The transmission gear train drives the cutter assembly. The cutter assembly drives the feeding device. The feeding reverse device and manual reverse mechanism control the motor by a control circuit.

The motor 9 is attached to the enclosure 15 and comprises an axle sticking out from the motor 9. The motor 9 is connected with a power supply by a power cord 14 and a control circuit. The pinion 16 is coupled with the axle of the motor 9. The transmission gear train comprises a first transmission gear 17, a second transmission gear 18, and a third transmission gear 6. The pinion 16 meshes with the first transmission gear 17. The second transmission gear 18 meshes with the first transmission gear 17. The third transmission gear 6 meshes with the second transmission gear 18.

The cutter assembly comprises a blade support 21, a blade 4 mounted on the blade support 21, a pinion 36 fixed to one end portion of the blade support 21 and coaxial with the blade 4, and an inner ring gear 5 meshing with the pinion 36. The third transmission gear 6 is fixed on the blade support 21 and rotationally drives the blade support 21. The blade 4 on the blade support 21 simultaneously rotates with the blade support 21 and rotates to the inner ring gear 5, thereby shaving a pencil 30 in the sharpener. An active component 3 is fixed on the other end portion of the blade support 21.

Figure 2:
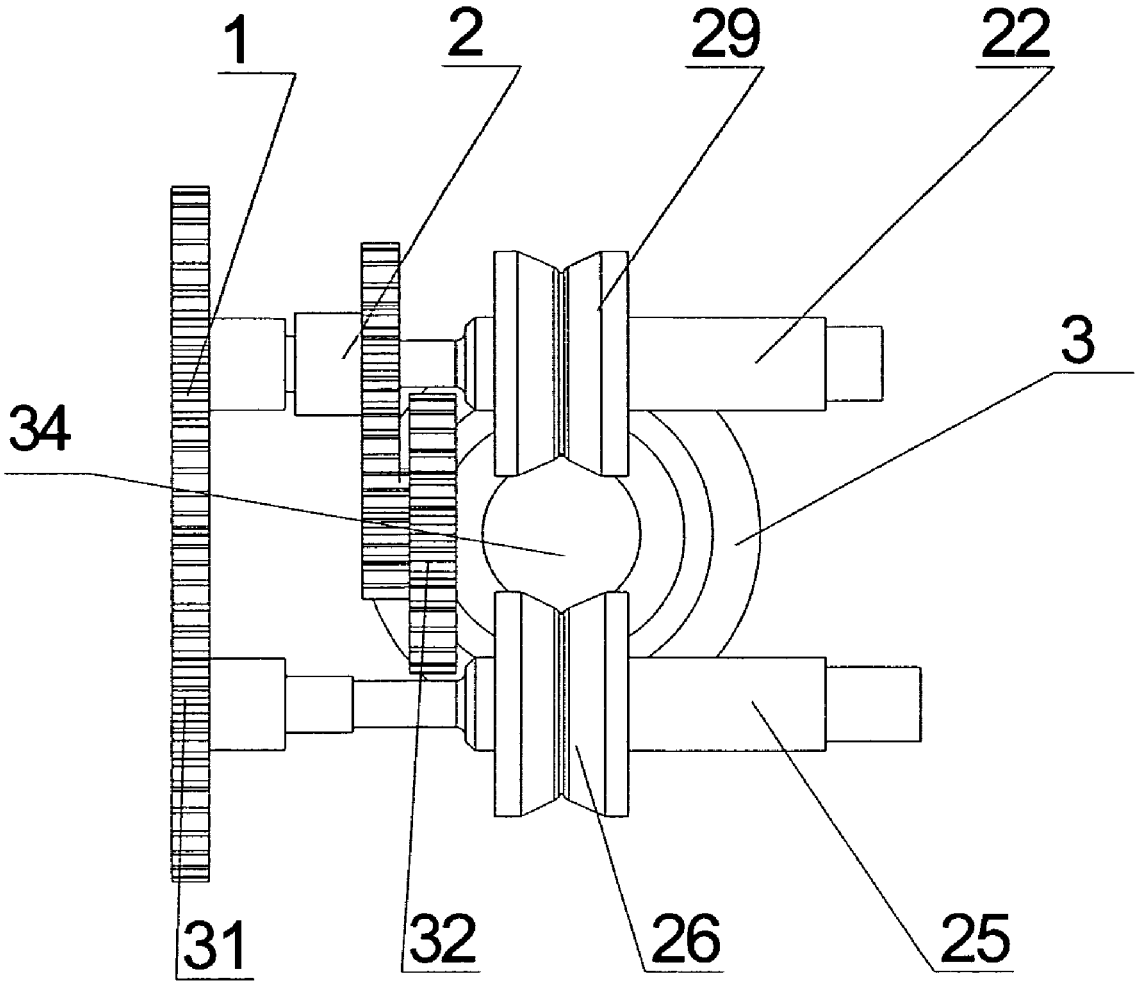
FIG. 2 is a schematic view of the automatic pencil sharpener from FIG. 1 showing a feeding device.
Figure 3:
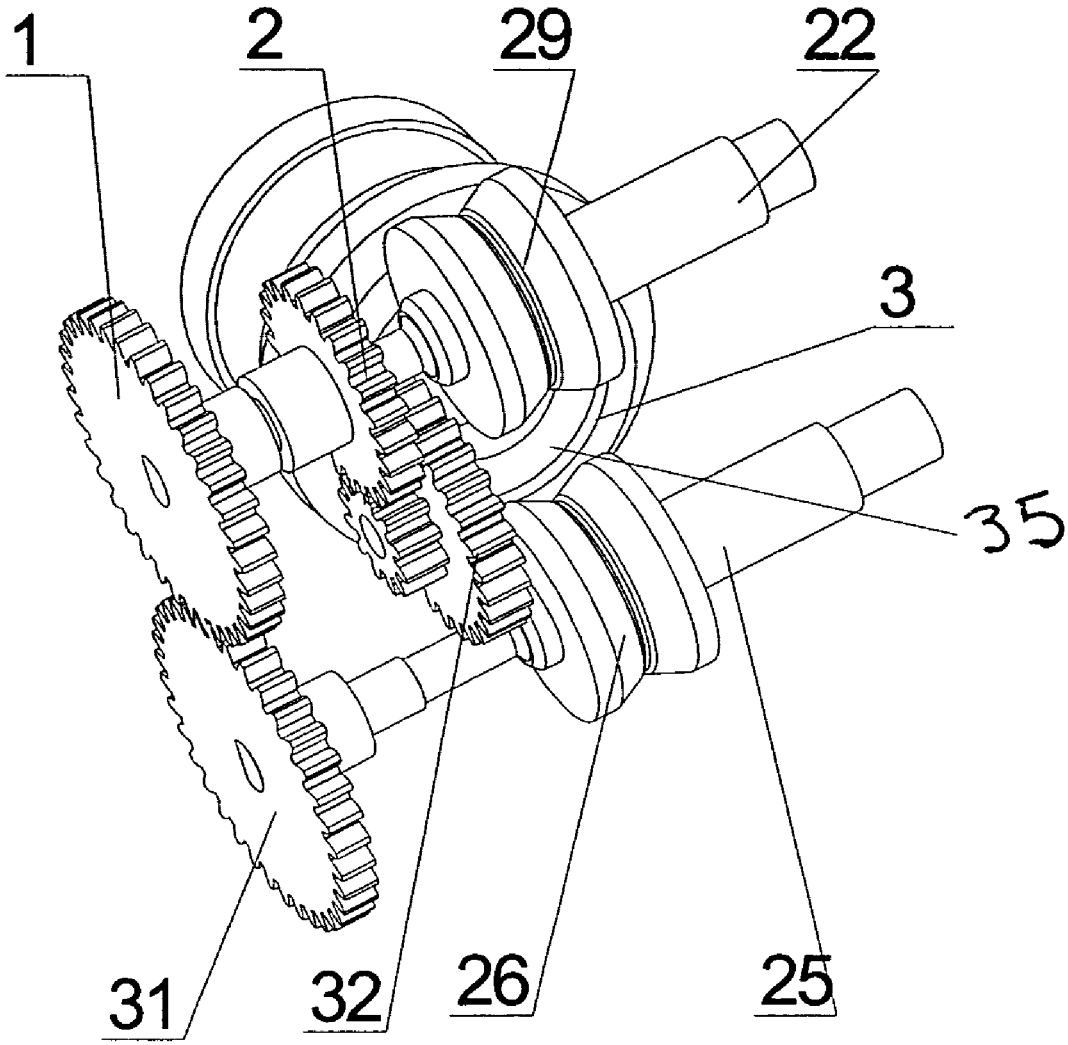
FIG. 3 is a perspective view of the feeding device from FIG. 2.

Further, referring to FIGS. 2 and 3, the feeding device comprises a first passive assembly, a second passive assembly, a first feeding roller 29, and a second feeding roller 26. The active component 3 rotates with the blade support 21 and drives the first passive assembly. The first passive assembly drives the second passive assembly and the first feeding roller 29 so as to rotate in a first direction. The second passive assembly alters the transmission direction and drives the second feeding roller 26 so as to rotate in a second direction which is opposite to the first direction of the first feeding roller 29. Thereby, the power from the active component 3 is successively transmitted through the first and second passive assemblies so as to rotate the first feeding roller 29 and the second feeding roller 26 in opposite directions. A gap 35 for the pencil 30 to pass through is defined between the first feeding roller 29 and the second feeding roller 26. The first feeding roller 29 and the second feeding roller 26 are located at the entrance of the sharpener for the pencil 30, and respectively lie on two opposite sides of the pencil 30.

In a preferred embodiment, the active component 3 on the blade support 21 is a crown gear. A passage 34 is defined in the central portion of the crown gear 3 for receiving the pencil 30 to be shaved. The passage 34 is aligned with the gap 35 between the first feeding roller 29 and the second feeding roller 26. The first passive assembly comprises a first gear module and a first rolling shaft 22 that supports the first gear module and the first feeding roller 29. The second passive assembly comprises a second gear module and a second rolling shaft 25 that supports the second gear module and the second feeding roller 26. The first feeding roller 29 and the second feeding roller 26 are flexible rubber rings. The first gear module of the first passive assembly comprises a first gear 32, a second gear 2, and a third gear 1. The second gear module of the second passive assembly comprises a fourth gear 31 supported on the second rolling shaft 25. The first gear 32 meshes with the crown gear 3. The second gear 2 is supported on the first rolling shaft 22 and meshes with the first gear 32. The third gear 1 is supported on a distal end of the rolling shaft 22 and meshes with the fourth gear 31 on the second rolling shaft 25. The power from the crown gear 3 is transferred to the first rolling shaft successively passing through the first gear 32 and the second gear 2. The first rolling shaft 22 transfers the power from the crown gear 3 to the second rolling shaft 25 and the second feeding roller 26 successively passing through the third gear 1 and the fourth gear 31. In an embodiment, the pencil is automatically fed by the friction force between the surface of the pencil and the surface of the first and second feeding rollers 29, 26.

The feeding device defines an entrance and an outlet. The pencil 30 is inserted into the gap 35 between the first feeding roller 29 and the second feeding roller 26 through the entrance and through the outlet thereof. The outlet is in communication with the processing area of the cutter assembly. The pencil fed into the feeding device reaches the processing area of the cutter assembly for shaving. A start switch 27 and a first touch tab 28 abut the start switch 27. A stop switch 24 and a second touch tab 23 are arranged near the entrance to the feeding device. The start switch 27 and the stop switch 24 are connected to the power supply. The first touch tab 28 and the second touch tab 23 are in correspondence with the feeding path of the pencil 30 locomotion. The second tab 23 is located between the first tab 28 and the feeding device, and at the same time is located between the first rolling shaft 22 and the second rolling shaft 25.

The manual reverse mechanism comprises a pushing rod 12 and a key switch 11 abutting the pushing rod 12. The key switch 11 is connected with the power supply. The pushing rod 12 can be moved up and down along a guiding passage defined in the enclosure 15. When the pushing rod 12 is upwardly raised to a position where the key switch 11 is triggered to start the motor 9, the motor will rotate in a reverse direction.

The automatic pencil sharpener further comprises a feeding reverse mechanism. The feeding reverse mechanism comprises a slide block 20, a triggering post 7, and a reversal switch 8. The slide block 20 is embedded in a slide way 33 defined in the blade support 21 and is configured to slide back and forth along the slide way 33. The slide block 20 is located on the path of the feeding pencil 30. The triggering post 7 is supported on the blade support 21. One end point of the triggering post 7 is in close proximity to the slide block 20. Another end point sticks out of the blade support 21 and is in close proximity to the reversal switch 8. When the slide block 20 pushes the triggering post 7 and the triggering post 7 pushes the reversal switch 8, the motor 9 starts to rotate in a reverse direction.

Figure 4:
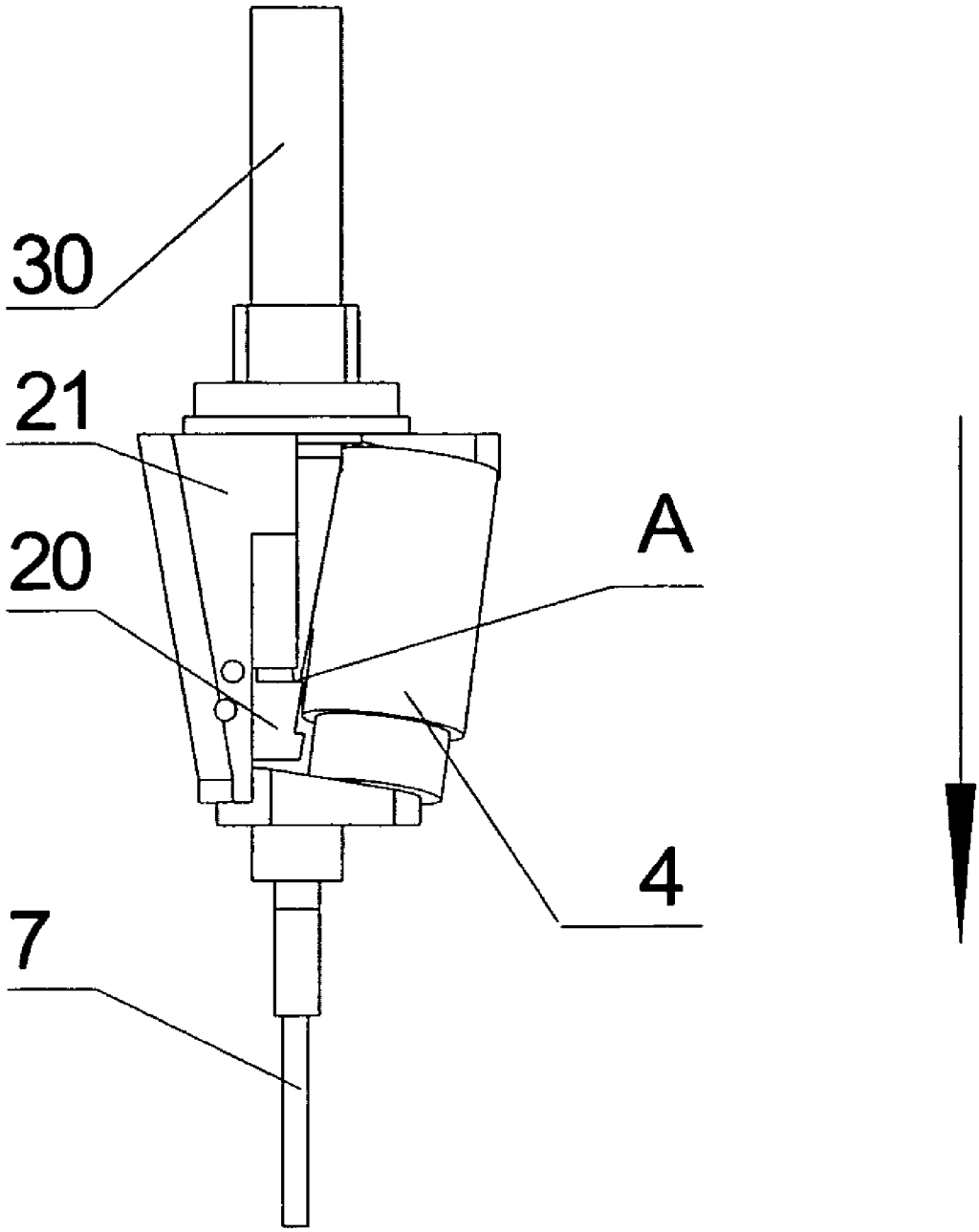
FIG. 4 is a schematic view of the automatic pencil sharpener from FIG. 1 showing the feeding device shaving a pencil in position A.
Figure 5:
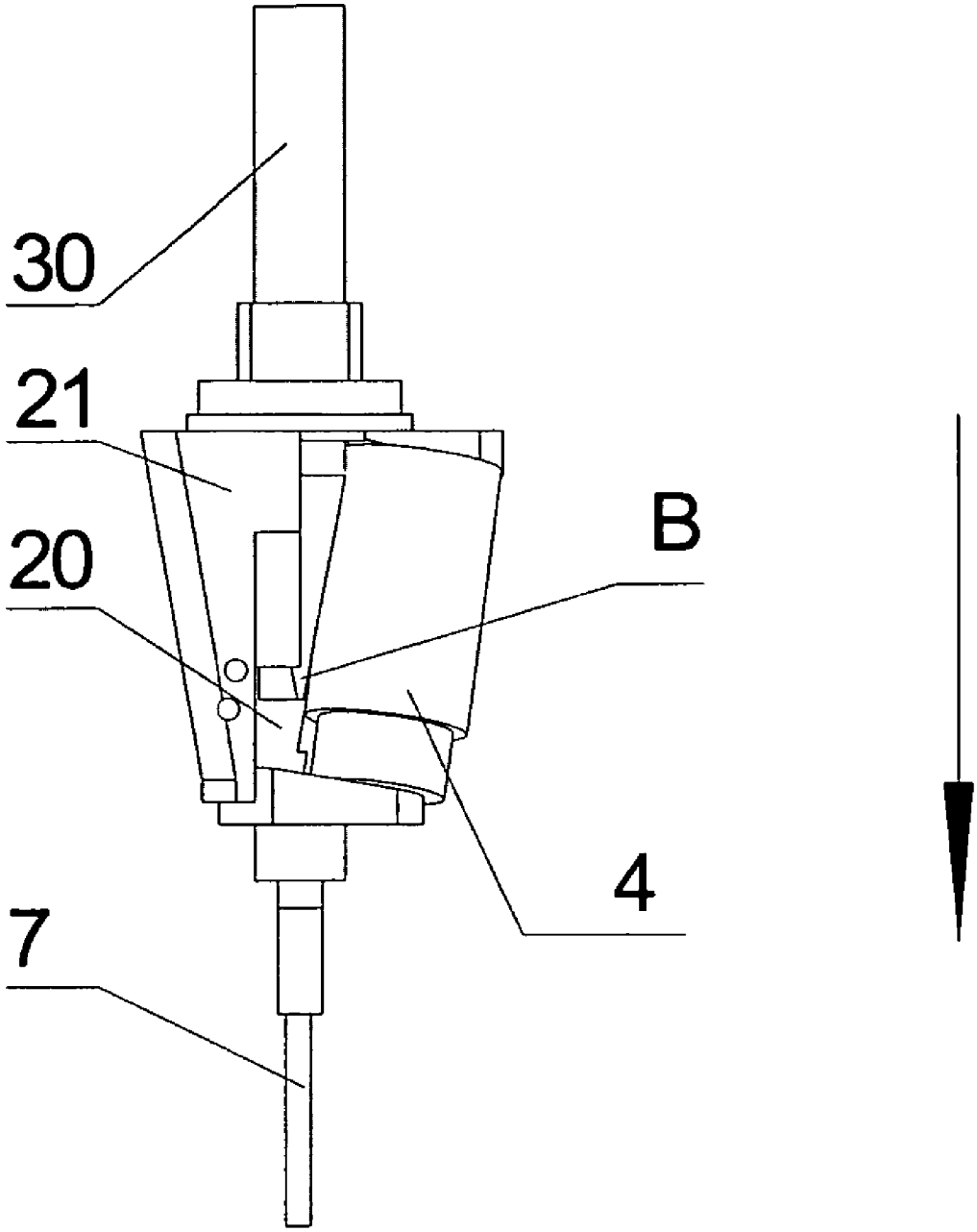
FIG. 5 is a schematic view of the automatic pencil sharpener from FIG. 1 showing the feeding device shaving a pencil in position B.
Figure 6:
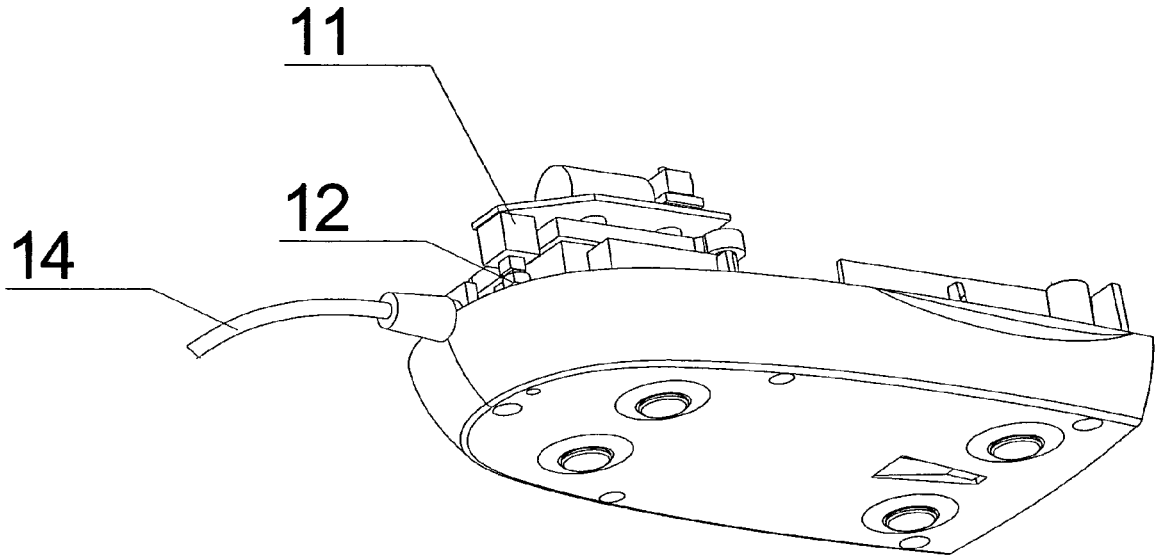
FIG. 6 is a perspective, bottom, schematic view of the automatic pencil sharpener from FIG. 1, showing manual operation to reverse the motor.

Further referring to FIG. 4 to FIG. 6, a method of working the pencil sharpener of the preferred embodiments is as follows. The pencil 30 is inserted into the gap 35 between the first feeding roller 29 and the second feeding roller 26. The pencil 30 will press the first touch tab 28 abutting the start switch 27 at the entrance of the feeding device and the second touch tab 23 abutting the stop switch 24. When the first touch tab 28 is pressed down, the motor 9 starts to rotate in a first feeding direction. The power of the motor 9 is transmitted successively through the pinion 16 on the axle of the motor 9, the first transmission gear 17, the second transmission gear 18 and the third transmission gear 6 and rotatively drives the blade support 21 of the cutter assembly. The crown gear 3 at the distal end of the blade support 21 rotates with the blade support 21.

The rotating crown gear 3 rotatively drives the first feeding roller 29 on the first rolling shaft 22 in a first direction through the transmission of the first gear 32 and the second gear 2. At the same time, the rotating crown gear 3 rotatively drives the second feeding roller 26 on the second rolling shaft 25 in a second direction opposite to the first direction through the transmission of the first gear 32, the second gear 2, the third gear 1 and the fourth gear 31. When viewed from the left side, the first feeding roller 29 rotates in the clockwise direction and the second feeding roller 26 rotates in the counterclockwise direction (shown in FIG. 2 and FIG. 3). Therefore, the two feeding rollers 29, 26 simultaneously squeeze surfaces of the pencil 30 to generate feeding friction force. The friction feeding of the two feeding rollers 29, 26 takes the place of a user manually feeding the pencil while shaving and achieves pencil self-feeding.

The following describes how the pencil 30 retreats from the pencil sharpener. When the pencil 30 that is being shaved and fed by the two feeding rollers 29, 26, reaches position A, the nib of the pencil 30 will touch the slide block 20 (shown in FIG. 4). The pencil 30 is further fed by the two feeding rollers 29, 26, and continues to move forward into the sharpener. At this time, the nib of the pencil 30 will push the slide block 20 to move along the slide way 33. The slide block 20 pushed by the pencil 30 continuously pushes the triggering post 7 to move outward. When the pencil 30 fed by the two feeding rollers 29, 26 reaches position B (shown in FIG. 5), the end point of the moving triggering post 7 near the reversal switch 8 will trigger the reversal switch 8 to start the motor 9 to rotate in a reverse direction to the original direction.

After the motor 9 changes its rotating direction, the transmission route and feeding means is the same as that described in the pre-changed state. There is a difference in that the motor 9 rotation direction and the feeding rollers 29, 26 are modified to rotate the feeding rollers 29, 26 in opposite directions. In this situation and when viewed from a left side, the first feeding roller 29 rotates in a counterclockwise direction and the second feeding roller 26 rotates in a clockwise direction. The two feeding rollers 29, 26 simultaneously reverse to squeeze surfaces of the pencil 30 to generate retreating friction force. When the pencil 30 is retreated from the cutter assembly to where the second touch tab 23 is located, the retreating pencil 30 releases the second touch tab 23. The released second touch tab 23 is replaced and releases the stop switch 24 to shut off the power supply of the motor 9. Thereby, the pencil is completely retreated out from the sharpener and the power of the sharpener is off. The friction pencil retreating from the two feeding rollers 29, 26 takes the place of manual pencil retreating and achieves pencil self-retreating of the preferred embodiments.

When the pencil 30 is too short, the caudal portion of the pencil 30 gets through the second touch tab 23 but the head portion of the pencil 30 does not yet reach position B so as to trigger the reversal switch 8. Releasing the second touch tab 23 will release the stop switch 24 to shut off the power supply of the motor 9 and stop the shaving procedure. The short pencil 30 will stop in the cutter assembly. At this time, pressing the pushing rod 12 (shown in FIG. 6) triggers the key switch 11. The motor 9 will rotate in a reverse direction to retreat the short pencil 30 out from the sharpener.

Having thus described particular embodiments, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and not limiting.

What is claimed is:

1. An automatic pencil sharpener comprising:

a motor;

a transmission device operatively coupled to the motor;

a cutter assembly operatively coupled to the transmission device and being adapted to shave a front portion of a pencil;

a feeding device operatively coupled to the transmission device and defining a gap the front portion of the pencil being fed along a feeding path and into the gap so as to be shaved by the cutter assembly;

a start switch disposed near the gap of the feeding device and being triggered by insertion of the pencil to start the motor; and a stop switch disposed adjacent to the start switch and along the feeding path, the stop switch stopping the motor in response to a rear portion of the pencil passing by the start switch so as to inhibit the pencil from being jammed in the cutter assembly.

2. The automatic pencil sharpener of claim 1, wherein the transmission device is a gear train, wherein the gear train comprises a pinion on the motor, a first, second and third transmission gears, successively meshing with one another in turn.

3. The automatic pencil sharpener of claim 1, wherein the feeding device comprises an active component driven by the motor, a first feeding roller and a second feeding roller, and wherein the pencil is sandwiched between the first and second feeding rollers and power is transmitted from the active component successively to the first feeding roller and the second feeding roller, and wherein a rotating direction of the first feeding roller is reverse to that of the second feeding roller.

4. The automatic pencil sharpener of claim 3, wherein the feeding device further comprises a first passive assembly and a second passive assembly, wherein the active component is engaged with the first passive assembly, the first passive assembly is connected with the first feeding roller and is engaged the second passive assembly, and wherein the second passive assembly is connected with the second feeding roller.

5. The automatic pencil sharpener of claim 4, wherein the first passive assembly comprises a first, second and third gears, and a first rolling shaft supporting the first feeding roller, the second and the third gear, wherein the first gear meshes with the active component and the second gear meshes with the first gear.

6. The automatic pencil sharpener of claim 5, wherein the second passive assembly comprises a fourth gear and a second rolling shaft supporting the second feeding roller, wherein the forth gear meshes with the third gear supported on the first rolling shaft.

7. The automatic pencil sharpener of claim 3, wherein the active component is a crown gear.

8. The automatic pencil sharpener of claim 7, wherein the cutter assembly comprises a blade support engaged with the transmission device, a blade fixed on the blade support, a pinion coaxial with the blade, and an inner ring gear meshing with the pinion, wherein the crown gear is mounted on a distal end of the blade support.

9. The automatic pencil sharpener of claim 1, wherein further comprising the feeding reverse mechanism comprises a slide block, a triggering post and a reversal switch, wherein the slide block is configured to slide on the cutter assembly, standing in a processing path of the pencil, wherein the slide block is engaged with one end point of the triggering post and the another endpoint of the triggering post is engaged with the reversal switch, wherein the reversal switch is connected with the motor.

10. The automatic pencil sharpener of claim 1 further comprising a first touch tab abutting the start switch and a second touch tab abutting the stop switch, the first and second touch tabs standing in the feeding path of the pencil.

11. An automatic pencil sharpener comprising:

an enclosure;

a motor disposed in the enclosure;

a transmission device operatively coupled to the motor;

a cutter assembly operatively coupled to the transmission and being adapted to shave a front portion of a pencil;

a feeding device operatively coupled to the transmission device and defining a gap, the front portion of the pencil being fed along a feeding path and into the gap so as to be shaved the cutter assembly;

a feeding reverse mechanism for retreating the pencil from the sharpener; and a manual reverse mechanism for reversing a direction of rotation for the motor, the manual reverse mechanism having a key switch, at least a portion of the key switch being disposed outside of the enclosure so as to allow a user to manually reverse the direction of rotation for the motor by actuating the exposed portion of the key switch, the pencil retreating from the sharpener when the key switch is actuated.

12. The automatic pencil sharpener of claim 11, wherein the transmission device is a gear train, wherein the gear train comprises a pinion on the motor, a first, second and third transmission gear, successively meshing with one another in turn.

13. The automatic pencil sharpener of claim 11, wherein the feeding device comprises an active component driven by the motor, a first feeding roller and a second feeding roller, and wherein the pencil is sandwiched between the first and second feeding rollers, and power is transmitted from the active component successively to the first feeding roller and the second feeding roller, and wherein a rotating direction of the first feeding roller is reverse to that of the second feeding roller, the feeding device further comprises a first passive assembly and a second passive assembly, wherein the active component is engaged with the first passive assembly, and wherein the first passive assembly is connected with the first feeding roller and is engaged the second passive assembly, wherein the second passive assembly is connected with the second feeding roller.

14. The automatic pencil sharpener of claim 13, wherein the first passive assembly comprises a first, second and third gear, and a first rolling shaft supporting the first feeding roller, the second and the third gear, wherein the first gear meshes with the active component and the second gear meshes with the first gear.

15. The automatic pencil sharpener of claim 14, wherein the second passive assembly comprises a fourth gear and a second rolling shaft supporting the second feeding roller, wherein the fourth gear meshes with the third gear supported on the first rolling shaft.

16. The automatic pencil sharpener of claim 13, wherein the active component is a crown gear, and the cutter assembly comprises a blade support engaged with the transmission device, a blade fixed on the blade support, a pinion coaxial with the blade and an inner ring gear meshing with the pinion, wherein the crown gear is mounted on a distal end of the blade support.

17. The automatic pencil sharpener of claim 11, wherein the feeding reverse mechanism comprises a slide block, a triggering post and a reversal switch, wherein the slide block is configured to slide on the cutter assembly, standing in a processing path of the pencil, wherein the slide block is engaged with one end point of the triggering post and the another endpoint of the triggering post is engaged with the reversal switch, wherein the reversal switch is connected with the motor.

18. The automatic pencil sharpener of claim 11, wherein a start switch, a first touch tab abutting the start switch, a stop switch and a second touch tab abutting the stop switch are provided near the gap of the feeding device, wherein the start switch and the stop switch are connected with the motor and the first and second touch tabs are standing in a feeding path of the pencil.

19. The automatic pencil sharpener of claim 11, wherein the manual reverse mechanism further comprises a pushing rod sticking out from the enclosure, the pushing rod being engaged with the key switch.

* * * * *